US010300503B2

(12) United States Patent
Mori et al.

(10) Patent No.: US 10,300,503 B2
(45) Date of Patent: May 28, 2019

(54) FLUID APPLICATION SYSTEM AND FLUID APPLICATION METHOD

(71) Applicant: HEISHIN LTD., Hyogo (JP)

(72) Inventors: Masaki Mori, Nagahama (JP); Yoshihiro Sugino, Nagahama (JP); Hideaki Wakizaka, Nagahama (JP)

(73) Assignee: HEISHIN LTD., Hyogo (JP)

( * ) Notice: Subject to any disclaimer, the term of this patent is extended or adjusted under 35 U.S.C. 154(b) by 0 days.

(21) Appl. No.: 14/915,855

(22) PCT Filed: Aug. 27, 2014

(86) PCT No.: PCT/JP2014/004390
§ 371 (c)(1),
(2) Date: Mar. 1, 2016

(87) PCT Pub. No.: WO2015/033535
PCT Pub. Date: Mar. 12, 2015

(65) Prior Publication Data

US 2016/0193621 A1 Jul. 7, 2016

(30) Foreign Application Priority Data

Sep. 9, 2013 (JP) ..... 2013-185917

(51) Int. Cl.
*B05B 12/12* (2006.01)
*B05B 13/04* (2006.01)
(Continued)

(52) U.S. Cl.
CPC ..... *B05B 12/12* (2013.01); *B05C 5/0212* (2013.01); *B05C 11/1005* (2013.01); *B05D 1/02* (2013.01);
(Continued)

(58) Field of Classification Search
None
See application file for complete search history.

(56) References Cited

U.S. PATENT DOCUMENTS 4,899,691 A * 2/1990 Fitzgerald, Jr. ..... B05C 11/025 118/126

FOREIGN PATENT DOCUMENTS

EP 2 202 005 A1 6/2010
JP 2000-345970 A 12/2000
(Continued)

OTHER PUBLICATIONS

International Search Report—PCT/JP2014/004390 dated Nov. 4, 2014.
Written Opinion—PCT/JP2014/004390 dated Nov. 4, 2014.

*Primary Examiner* — Jethro M. Pence
(74) *Attorney, Agent, or Firm* — Studebaker & Brackett PC

(57) ABSTRACT

A fluid application system includes: an application apparatus that discharges a fluid to a workpiece; a movement apparatus that moves the application apparatus and the workpiece; and a control apparatus. At the time of adjusting the output of a power source to thereby vary the discharge amount of the fluid from the nozzle by a target variation amount F1, the control apparatus sets the output of the power source to a value beyond a theoretical output N1 of the power source obtained from the target variation amount F1 of the discharge amount, and then sets the output of the power source to the theoretical output N1 such that the change amount of the internal pressure of the nozzle is coincident with an amount P1 by which the internal pressure of the nozzle needs to change, the amount P1 being obtained from the target variation amount F1 of the discharge amount.

12 Claims, 9 Drawing Sheets

(51) Int. Cl.

| | |
|---|---|
| ***B05B 9/04*** | (2006.01) |
| ***B05D 1/02*** | (2006.01) |
| ***B05C 5/02*** | (2006.01) |
| ***B05C 11/10*** | (2006.01) |
| *B05D 1/26* | (2006.01) |
| *B05B 12/08* | (2006.01) |

(52) U.S. Cl.
CPC ..... *B05B 9/0416* (2013.01); *B05B 12/085* (2013.01); *B05B 13/0431* (2013.01); *B05D 1/26* (2013.01)

(56) References Cited

FOREIGN PATENT DOCUMENTS

| | | | |
|---|---|---|---|
| JP | 2005-288387 | * | 10/2005 |
| JP | 2005-288387 | A | 10/2005 |
| JP | 3769261 | B2 | 4/2006 |
| JP | 2010-104945 | A | 5/2010 |
| JP | 2012-045476 | A | 3/2012 |
| JP | 5154879 | B2 | 2/2013 |
| TW | 200936250 | A | 9/2009 |

* cited by examiner

FLUID APPLICATION SYSTEM AND FLUID APPLICATION METHOD

TECHNICAL FIELD

The present invention relates to a fluid application system including: an application apparatus that discharges a fluid from a nozzle to a workpiece; and a movement apparatus that relatively moves the application apparatus and the workpiece. The present invention also relates to a fluid application method using the fluid application system.

BACKGROUND ART

In a process of manufacturing an automobile, an electronic member, a solar cell, and the like, a fluid such as an adhesive agent, a sealing agent, an insulating agent, a heat releasing agent, and an anti-seizure agent is applied to a workpiece in some cases. A fluid application system is used to apply the fluid to the workpiece. The fluid application system includes: an application apparatus (example: a dispenser) that discharges the fluid to the workpiece; and a movement apparatus (example: an articulated robot) that relatively moves the application apparatus and the workpiece.

The application apparatus includes: a power source (example: a motor): a fluid supply apparatus (example: a pump, an actuator) that changes the supply amount of the fluid per unit time in accordance with the output of the power source; and a nozzle that discharges the fluid supplied from the fluid supply apparatus, to the workpiece. When the fluid is applied to the workpiece, while the fluid is discharged by the application apparatus such that the line width of the fluid on the workpiece is constant, the nozzle is moved in a linear manner, is then moved in an arc-like manner, and is then moved in a linear manner with respect to the workpiece by the movement apparatus in some cases.

FIG. 1 is a schematic diagram illustrating the form of the fluid that is applied to the workpiece in the case where movement of the nozzle with respect to the workpiece is performed in order of a linear manner, an arc-like manner, and a linear manner. In FIG. 1, the region of a fluid 51 applied to a workpiece 50 is indicated by shading, and the application direction is indicated by shaded arrows. If the movement of the nozzle with respect to the workpiece 50 is performed in order of a linear manner, an arc-like manner, and a linear manner, as illustrated in FIG. 1, the fluid 51 applied to the workpiece 50 (hereinafter, also simply referred to as the "applied fluid") is formed as a first linear part 51*a* up to a position A, an arc-like part 51*b* from the position A up to a position B, and a second linear part 51*c* starting from the position B. On this occasion, the movement speed of the nozzle is changed by the movement apparatus in some cases.

FIG. 2A to FIG. 2D are schematic diagrams illustrating an example of control in the case of changing the movement speed of the nozzle when the movement of the nozzle with respect to the workpiece is performed in order of a linear manner, an arc-like manner, and a linear manner. Of these drawings, FIG. 2A illustrates the relation between the elapsed time and the movement speed. FIG. 2B illustrates the relation between the elapsed time and the rotation speed of the motor (power source) of the application apparatus. FIG. 2C illustrates the relation between the elapsed time and the discharge amount from the nozzle. FIG. 2D illustrates the form of the applied fluid on the workpiece. A position A and a position B illustrated in FIG. 2A to FIG. 2D respectively correspond to the position A and the position B illustrated in FIG. 1. In FIG. 2D, an ideal form of the applied fluid in the case where a response delay in the discharge amount is suppressed is indicated by long dashed double-short dashed lines, and the application direction is indicated by shaded arrows.

As illustrated in FIG. 2A, with respect to the workpiece, the nozzle linearly moves at a high speed in the first linear part, starts decelerating just before the position A that is the end point of the first linear part, and ends decelerating at the position A. After the deceleration end, the nozzle moves at a low speed in the arc-like part. The nozzle starts accelerating at the position B that is the start point of the second linear part, and moves at a high speed after the acceleration end.

In the case of changing the movement speed of the nozzle in this way, for example, if the relative movement speed between the nozzle and the workpiece decreases, in order to make the line width of the applied fluid constant, it is necessary to decrease the discharge amount of the fluid per unit time (hereinafter, also simply referred to as the "discharge amount") from the nozzle in accordance with the decrease in the movement speed. On the other hand, if the relative movement speed between the nozzle and the workpiece increases, in order to make the line width of the applied fluid constant, it is necessary to increase the discharge amount from the nozzle in accordance with the increase in the movement speed.

Here, in the above-mentioned application apparatus including the power source (example: a motor), the fluid supply apparatus (example: a pump), and the nozzle, if the behavior of the power source is in a stable state, the discharge amount has a positive correlation with the output of the power source (example: the rotation speed of a motor), and the discharge amount increases as the output of the power source increases. Accordingly, in order to control the discharge amount from the nozzle in accordance with a change in the movement speed of the nozzle with respect to the workpiece for the purpose of making the line width of the applied fluid constant, the output of the power source (example: the rotation speed of a motor) may be varied.

Specifically, as illustrated in FIG. 2B, from the state where the rotation speed of the motor is constant, the rotation speed of the motor is decreased in accordance with deceleration in the movement speed of the nozzle, and then the rotation speed of the motor is made constant at the timing at which the movement speed becomes low. After that, the rotation speed of the motor is increased in accordance with acceleration in the movement speed of the nozzle, and then the rotation speed of the motor is made constant at the timing at which the movement speed becomes high.

When the rotation speed of the motor is varied in accordance with a change in the movement speed of the nozzle in this way, a change in the discharge amount takes time to follow a change in the rotation speed of the motor, so that a response delay in the discharge amount occurs. Consequently, the line width of the applied fluid changes, and hence the line width of the applied fluid cannot be made constant.

Specifically, as illustrated in FIG. 2C, the discharge amount of the fluid from the nozzle does not follow a change in the movement speed of the nozzle due to such a response delay. Hence, the line width of the applied fluid is not constant. As a result, as illustrated in FIG. 2D, the line width of the applied fluid is thicker in the arc-like part and part of the second linear part continuous with the arc-like part.

With regard to a fluid application method using the fluid application system including the application apparatus and the movement apparatus, various techniques have been proposed up to now (for example, Japanese Patent No. 5154879 (Patent Literature 1) and Japanese Patent No. 3769261 (Patent Literature 2)). Patent Literature 1 discloses an application method for a liquid material. In this application method, a workpiece placed on a table and a discharge unit including a screw type dispenser opposed to the workpiece are relatively moved at a non-constant speed, and the liquid material is continuously applied with the discharge amount of the liquid material being non-constant. Specifically, when the discharge amount of the liquid material is changed, the rotation speed of a screw is varied up to a predetermined change rate with a constant gradient.

The application method of Patent Literature 1 includes a response time calculation step, a response time adjustment step, and a discharge amount adjustment step, in order to adjust the change start position of the screw rotation speed and the change rate of the screw rotation speed in the course of varying the screw rotation speed. In the response time calculation step, a response delay time at the time of changing the discharge amount is calculated before application start. In the response time adjustment step, the response delay time at the time of changing the discharge amount is adjusted. In the discharge amount adjustment step, the discharge amount is adjusted such that the volume per unit length of the applied liquid material is constant. Patent Literature 1 describes that, in forming an application pattern made of an arc-like part and a linear part, this application method can keep the application amount and the form of the liquid material uniform in the case where the movement speed changes between the arc-like part and the linear part.

Patent Literature 2 discloses a pattern formation method for a display panel. In this pattern formation method, a dispenser discharges a paste while relatively moving with respect to a substrate, whereby a paste layer in a predetermined pattern is formed on the substrate. A screw thread type dispenser or a dispenser including a two-degree-of-freedom actuator (hereinafter, also referred to as the "dispenser with the two-degree-of-freedom actuator") is used as the dispenser. The dispenser with the two-degree-of-freedom actuator is a dispenser including a first actuator and a second actuator combined with each other. The first actuator linearly drives a piston to thereby generate a positive or negative squeezing pressure on an exit-side end face of the piston. The second actuator rotates the piston on which a screw thread is formed, to thereby generate a pumping pressure and feed a fluid to be applied to the exit side under pressure.

In the case of using the screw thread type dispenser in the pattern formation method of Patent Literature 2, at the time of application start, rotations of the screw thread are accelerated and are then promptly returned to steady rotations. Consequently, kinetic energy that is high enough to overcome a surface tension is given to the fluid immediately after discharge start, and hence the application can be started without forming a clot of the fluid at the leading end of a nozzle. On the other hand, at the time of application end, the rotations of the screw thread are rapidly decelerated and stopped. Consequently, a clot of the fluid at the nozzle leading end can be made as little as possible, and the fluid can be prevented from dripping off at the time of application restart.

Moreover, in the case of using the dispenser with the two-degree-of-freedom actuator in the pattern formation method of Patent Literature 2, at the time of application start, rotations of a motor of a master pump that supplies the paste to the dispenser are started at the same time as the piston is moved downward, and then the dispenser is relatively moved while the motor is rotated, whereby the paste is discharged. Consequently, a precipitous peak pressure (overshoot) occurs in a combined pressure due to a squeezing effect produced along with the downward movement of the piston, and the application can be started without forming a clot of the fluid at the nozzle leading end. Here, the combined pressure is a pressure obtained by adding the squeezing pressure generated by the first actuator including the piston (the exit-side pressure of the first actuator) and the pumping pressure generated by the second actuator of screw type (the exit-side pressure of the second actuator).

On the other hand, at the time of application end, the rotations of the motor are stopped at the same time as the piston is moved upward, and the discharge of the paste is stopped. Consequently, the above-mentioned combined pressure precipitously drops, and a suck-back effect of sucking a clot of the fluid at the nozzle leading end by a slight amount to the inside of the nozzle is obtained. As a result, troubles such as dripping-off of a clot of the fluid can be avoided.

Meanwhile, as illustrated in FIG. 3 to be described below, the line width of the fluid 51 applied to the workpiece 50 is changed halfway in some cases.

FIG. 3 is a schematic diagram illustrating the form of the fluid that is applied to the workpiece in the case where the line width thereof changes halfway. In FIG. 3, the region of the applied fluid 51 on the workpiece 50 is indicated by shading. The line width of the applied fluid 51 illustrated in FIG. 3 changes halfway, and a first thin line part 51*d*, a thick line part 51*e*, and a second thin line part 51*f* appear in the stated order.

The applied fluid 51 made of the first thin line part 51*d*, the thick line part 51*e*, and the second thin line part 51*f* as described above is formed through, for example, the following procedure A of (1) to (3).

(1) With the use of a rectangular flat nozzle having a wide discharge port, the fluid is discharged at the same line width as those of the thin line parts (51*d* and 51*f*), and the applied fluid is formed in the region of the first thin line part 51*d* up to a position C.

(2) Subsequently, after the flat nozzle is moved past the region of the thick line part 51*e* from the position C up to a position D without applying the fluid to the region of the thick line part 51*e*, the discharge of the fluid is restarted, and the applied fluid is formed in the region of the second thin line part 51*f* from the position D.

(3) Lastly, the fluid is discharged at the same line width as that of the thick line part 51*e*, and the applied fluid is formed in the region of the thick line part 51*e* from the position C up to the position D.

According to the procedure A as described above, nozzle replacement in the application apparatus is necessary between the time of applying the fluid to the regions of the thin line parts and the time of applying the fluid to the region of the thick line part. In the case of manually performing this nozzle replacement, the replacement work is performed in the state where the apparatus is stopped. Hence, the application interruption time becomes longer, and the manufacture efficiency becomes lower. A nozzle replacement apparatus is used to achieve labor-saving nozzle replacement.

With regard to the nozzle replacement apparatus, various techniques have been proposed up to now (for example, Japanese Patent Application Publication No. 2010-104945 (Patent Literature 3)). Patent Literature 3 discloses a nozzle apparatus with a replacement function usable for fluid application using an application apparatus and a movement apparatus. The nozzle apparatus with the replacement function includes a nozzle with a replacement function, an engaging part, and an engaged part. The nozzle with the replacement function includes: a turn part to which a plurality of nozzles are attached: and a base part that turnably holds the turn part. In order to discharge a fluid supplied from a fluid supply port of the base part from a desired nozzle of the plurality of nozzles, the nozzle with the replacement function can rotationally move the desired nozzle to a predetermined discharge position. The engaging part is provided to the turn part. The engaged part is provided to a fixed-side part, and is disengageably engaged with the engaging part.

In the nozzle apparatus with the replacement function of Patent Literature 3, the base part is moved in the state where the engaging part is engaged with the engaged part, whereby the desired nozzle is rotationally moved to the discharge position. Consequently, a nozzle replacement drive mechanism for rotationally moving the desired nozzle to the discharge position is unnecessary, the application apparatus can be downsized, and apparatus costs can be reduced.

CITATION LIST

Patent Literature

Patent Literature 1: Japanese Patent No. 5154879
Patent Literature 2: Japanese Patent No. 3769261
Patent Literature 3: Japanese Patent Application Publication No. 2010-104945

SUMMARY OF INVENTION

Technical Problem

As described above, when the fluid is applied to the workpiece at a constant line width using the fluid application system including the application apparatus and the movement apparatus, the movement speed of the nozzle with respect to the workpiece is changed in some cases. In this case, if the discharge amount from the nozzle is controlled by varying the rotation speed of the motor (power source) in accordance with a change in the movement speed of the nozzle, the line width of the applied fluid changes due to a response delay in the discharge amount, and the line width cannot be made constant.

In this regard, in the technique of Patent Literature 1 described above, the change start position of the screw rotation speed and the change rate of the screw rotation speed are adjusted, whereby making the line width of the applied fluid constant is tried to be achieved. However, although the technique of Patent Literature 1 can improve a response delay in the discharge amount from the nozzle somewhat, the effect is insufficient, and the line width of the applied fluid still changes due to the response delay in the discharge amount.

Moreover, in the technique of Patent Literature 2 using the screw thread type dispenser described above, at the time of application start, rotations of the screw thread are accelerated and are then promptly returned to steady rotations, and, at the time of application end, the rotations of the screw thread are rapidly decelerated and stopped. However, Patent Literature 2 makes no discussion on changing the movement speed of the nozzle halfway during the application. Moreover, even if changing the movement speed of the nozzle halfway during the application is simply applied to the technique of Patent Literature 2, the line width of the applied fluid changes in some cases due to an overshoot or an undershoot of the discharge amount.

Further, in the technique of Patent Literature 2 using the dispenser with the two-degree-of-freedom actuator described above, the combined pressure (a pressure obtained by adding the squeezing pressure generated by the first actuator and the pumping pressure generated by the second actuator of screw type) is used at the time of application start and the time of application end. However, in Patent Literature 2, the combined pressure is not used to control the discharge amount.

Meanwhile, as described above, in the case where the line width of the fluid applied to the workpiece changes halfway, nozzle replacement in the application apparatus is necessary between the time of applying the fluid to the regions of the thin line parts and the time of applying the fluid to the region of the thick line part. In this regard, the nozzle replacement apparatus of Patent Literature 3 can be used. However, the fact remains that the manufacture efficiency becomes lower due to the nozzle replacement, and equipment costs rise due to installation of the nozzle replacement apparatus. Hence, fluid application without such nozzle replacement is desired.

Moreover, in the above-mentioned procedure A, it is necessary to first finish the thin line parts and then finish the thick line part. In this regard, in order to further enhance efficiency, it is desired to continuously apply the fluid to the regions of the thin line parts and the thick line part and thus finish these parts at a time. In the case of finishing the thin line parts and the thick line part at a time, it is necessary to vary the rotation speed of the motor and thus change the discharge amount at the boundary between the region of each thin line part and the region of the thick line part.

FIG. 4A to FIG. 4C are schematic diagrams illustrating an example of control when the fluid is applied at a time in the case where the line width thereof changes halfway. Of these drawings, FIG. 4A illustrates the relation between the elapsed time and the movement speed. FIG. 4B illustrates the relation between the elapsed time and the rotation speed of the motor (power source) of the application apparatus. FIG. 4C illustrates the form of the applied fluid on the workpiece. FIG. 4A to FIG. 4C illustrate the situation where the applied fluid made of the first thin line part 51*d*, the thick line part 51*e*, and the second thin line part 51*f* as illustrated in FIG. 3 is formed. A position C and a position D illustrated in FIG. 4A to FIG. 4C respectively correspond to the position C and the position D illustrated in FIG. 3. In FIG. 4C, an ideal form of the applied fluid in the case where a response delay in the discharge amount is suppressed is indicated by broken lines, and the application direction is indicated by shaded arrows.

As illustrated in FIG. 4A, the movement speed of the nozzle with respect to the workpiece is made constant, and, as illustrated in FIG. 4B, the rotation speed of the motor is changed at the boundary between the region of each thin line part and the region of the thick line part. If the fluid is applied at such a movement speed of the nozzle and such a rotation speed of the motor, as illustrated in FIG. 4C, a portion 51*g* in which the line width indistinctly changes due to a response delay in the discharge amount is formed at the boundary between each thin line part and the thick line part. Hence, in the case of changing the line width of the applied fluid halfway, the liquid cannot be applied at a time.

The present invention, which has been made in view of the above-mentioned circumstances, has an object to provide a fluid application system and a fluid application method capable of suppressing a response delay in the discharge amount of a fluid per unit time from a nozzle at the time of varying the discharge amount.

Solution to Problem

A fluid application system according to an embodiment of the present invention is a fluid application system including: an application apparatus that discharges a fluid to a workpiece: a movement apparatus that relatively moves the application apparatus and the workpiece; and a control apparatus that controls the application apparatus.

The application apparatus includes: a power source; a fluid supply apparatus that changes a supply amount of the fluid per unit time in accordance with an output of the power source; and a nozzle that discharges the fluid supplied from the fluid supply apparatus, to the workpiece.

At a time of adjusting the output of the power source in a course from application start up to application end to thereby vary a discharge amount of the fluid per unit time from the nozzle by a target variation amount, the control apparatus sets the output of the power source to a value beyond a theoretical output of the power source obtained from the target variation amount of the discharge amount, and then sets the output of the power source to the theoretical output such that a change amount of an internal pressure of the nozzle is coincident with an amount by which the internal pressure of the nozzle needs to change, the amount being obtained from the target variation amount of the discharge amount.

The above-mentioned system can be configured in the following manner.

At a time of decreasing a movement speed of the nozzle with respect to the workpiece and decreasing the output of the power source in accordance with the decrease in the movement speed to thereby decrease the discharge amount of the fluid per unit time from the nozzle by a target variation amount such that a line width of the fluid applied to the workpiece is constant, the control apparatus decreases the output of the power source beyond a theoretical output of the power source obtained from the target variation amount of the discharge amount, and then sets the output of the power source to the theoretical output such that the change amount of the internal pressure of the nozzle is coincident with an amount by which the internal pressure of the nozzle needs to drop, the amount being obtained from the target variation amount of the discharge amount.

The above-mentioned system can be configured in the following manner.

At a time of increasing the movement speed of the nozzle with respect to the workpiece and increasing the output of the power source in accordance with the increase in the movement speed to thereby increase the discharge amount of the fluid per unit time from the nozzle by a target variation amount such that the line width of the fluid applied to the workpiece is constant, the control apparatus increases the output of the power source beyond a theoretical output of the power source obtained from the target variation amount of the discharge amount, and then sets the output of the power source to the theoretical output such that the change amount of the internal pressure of the nozzle is coincident with an amount by which the internal pressure of the nozzle needs to rise, the amount being obtained from the target variation amount of the discharge amount.

The above-mentioned system can be configured in the following manner.

In a state where a movement speed of the nozzle with respect to the workpiece is constant, at a time of: decreasing the output of the power source to thereby decrease the discharge amount of the fluid per unit time from the nozzle by a target variation amount; and making a line width of the fluid applied to the workpiece thinner along with the decrease in the discharge amount, the control apparatus decreases the output of the power source beyond a theoretical output of the power source obtained from the target variation amount of the discharge amount, and then sets the output of the power source to the theoretical output such that the change amount of the internal pressure of the nozzle is coincident with an amount by which the internal pressure of the nozzle needs to drop, the amount being obtained from the target variation amount of the discharge amount.

The above-mentioned system can be configured in the following manner.

In the state where the movement speed of the nozzle with respect to the workpiece is constant, at a time of: increasing the output of the power source to thereby increase the discharge amount of the fluid per unit time from the nozzle by a target variation amount; and making the line width of the fluid applied to the workpiece thicker along with the increase in the discharge amount, the control apparatus increases the output of the power source beyond a theoretical output of the power source obtained from the target variation amount of the discharge amount, and then sets the output of the power source to the theoretical output such that the change amount of the internal pressure of the nozzle is coincident with an amount by which the internal pressure of the nozzle needs to rise, the amount being obtained from the target variation amount of the discharge amount.

The above-mentioned system can be configured in the following manner.

The fluid is a compressible fluid.

The above-mentioned system can be configured in the following manner.

The fluid supply apparatus includes: a motion element that makes a motion in accordance with the output of the power source; and a space formation member that forms a space for housing the motion element and sending out the fluid along with the motion of the motion element.

The above-mentioned system can be configured in the following manner.

The fluid supply apparatus is a uniaxial eccentric screw pump, and includes: a male-threaded rotor as the motion element; and a female-threaded stator as the space formation member.

The above-mentioned system can be configured in the following manner.

The movement apparatus is an articulated robot that moves the application apparatus.

A fluid application method according to an embodiment of the present invention is a method of applying a fluid to a workpiece using a fluid application system including: an application apparatus that discharges the fluid to the workpiece; and a movement apparatus that relatively moves the application apparatus and the workpiece.

The application apparatus includes: a power source; a fluid supply apparatus that changes a supply amount of the fluid per unit time in accordance with an output of the power source: and a nozzle that discharges the fluid supplied from the fluid supply apparatus, to the workpiece.

The method includes, at a time of adjusting the output of the power source in a course from application start up to application end to thereby vary a discharge amount of the fluid per unit time from the nozzle by a target variation amount, setting the output of the power source to a value beyond a theoretical output of the power source obtained from the target variation amount of the discharge amount, and then setting the output of the power source to the theoretical output such that a change amount of an internal pressure of the nozzle is coincident with an amount by which the internal pressure of the nozzle needs to change, the amount being obtained from the target variation amount of the discharge amount.

Advantageous Effects of Invention

According to the fluid application system and the fluid application method of the present invention, at the time of adjusting the output of the power source to thereby vary the discharge amount of the fluid from the nozzle, a response delay in the discharge amount can be suppressed. Hence, at the time of applying the fluid to the workpiece such that the line width of the applied fluid is constant, in the case of changing the movement speed of the nozzle, the line width of the applied fluid can be made constant. Moreover, in the case of applying the fluid while changing the line width of the applied fluid, a portion in which the line width indistinctly changes can be prevented from being formed at the boundary between a thick line part and a thin line part, and the fluid can be applied at a time.

DESCRIPTION OF EMBODIMENTS

In order to suppress a response delay in the discharge amount from a nozzle, the inventors of the present invention made earnest discussions and conducted various tests, focusing attention on the pressure of a fluid in an application apparatus. As a result, the inventors of the present invention found out that not the exit-side pressure of an actuator (fluid supply apparatus) as described in Patent Literature 2 but the internal pressure of the nozzle strongly influenced the response delay in the discharge amount.

In general, because a discharge port of the nozzle is more narrowed than an exit of the fluid supply apparatus, the internal pressure of the nozzle is higher than the exit-side pressure of the fluid supply apparatus due to a squeezing effect. The difference between the internal pressure of the nozzle and the exit-side pressure of the fluid supply apparatus is not constant, and changes depending on the discharge amount, the variation amount thereof, the inner diameter of the discharge port of the nozzle, the viscosity of the fluid, characteristics of a pump (fluid supply apparatus), and the like. Hence, it is important to consider the internal pressure of the nozzle.

Figure 5:
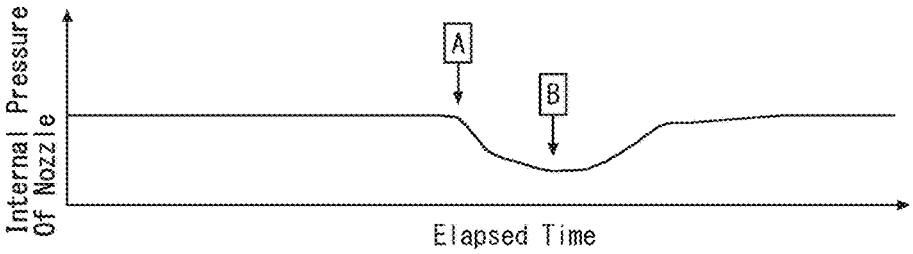
FIG. 5 is a schematic diagram illustrating the relation between the elapsed time and the internal pressure of the nozzle in the case where the discharge amount is controlled by varying the rotation speed of the motor (power source) of the application apparatus in accordance with a change in the movement speed of the nozzle with respect to the workpiece.

FIG. 5 is a schematic diagram illustrating the relation between the elapsed time and the internal pressure of the nozzle in the case where the discharge amount is controlled by varying the rotation speed of a motor (power source) of the application apparatus in accordance with a change in the movement speed of the nozzle with respect to a workpiece. FIG. 5 illustrates the internal pressure of the nozzle when the discharge amount is varied on the basis of the relation between the elapsed time and the rotation speed of the motor illustrated in FIG. 2B, in the relation between the elapsed time and the movement speed illustrated in FIG. 2A. As illustrated in FIG. 5, the internal pressure of the nozzle varies with a delay without following the change in the motor rotation speed illustrated in FIG. 2B.

In the case where the movement speed of the nozzle is changed while the line width of the applied fluid is made constant, if the output of the power source is adjusted such that the internal pressure of the nozzle follows the change in the movement speed, a response delay in the discharge amount is suppressed. As a result, the line width of the applied fluid can be made constant. Moreover, in the case where the fluid is applied at a time while the line width thereof is changed halfway, if the output of the power source is adjusted such that the internal pressure of the nozzle follows the change in the line width, a response delay in the discharge amount is suppressed. As a result, a portion in which the line width indistinctly changes can be prevented from being formed at the boundary between a thin line part and a thick line part, and the fluid can be applied at a time.

The present invention was completed on the basis of the above-mentioned findings. Hereinafter, embodiments of a fluid application system and a fluid application method of the present invention are described with reference to the drawings.

[Configuration Example of Fluid Application System]

Figure 6:
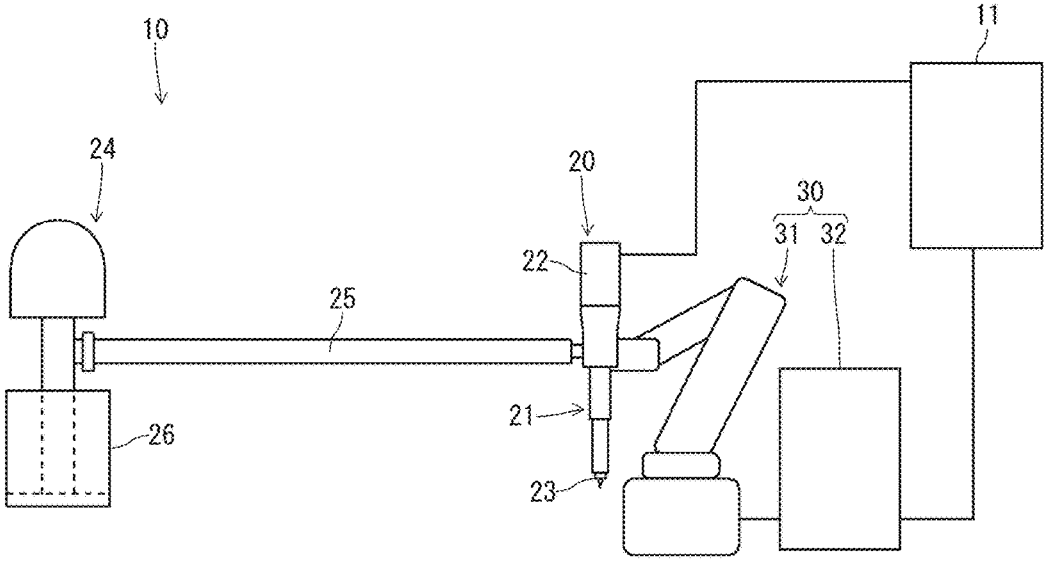
FIG. 6 is a schematic diagram illustrating a configuration example of a fluid application system according to an embodiment of the present invention.

FIG. 6 is a schematic diagram illustrating a configuration example of a fluid application system according to an embodiment of the present invention. A fluid application system 10 illustrated in FIG. 6 includes: an application apparatus 20 that discharges a fluid to a workpiece: a movement apparatus 30 that relatively moves the application apparatus 20 and the workpiece (omitted from the drawings); and a control apparatus 11 that controls the application apparatus 20.

The application apparatus 20 includes: a motor 22 that is a power source; a pump 21 that is a fluid supply apparatus; and a nozzle 23 attached to the leading end of the pump 21. The pump 21 can change the supply amount of the fluid per unit time in accordance with the output (rotation speed) of the motor 22. The nozzle 23 discharges the fluid supplied from the fluid supply apparatus 21, to the workpiece, and applies the fluid onto the workpiece. The motor 22 is connected to the control apparatus 11 by a cable. The control apparatus 11 specifies the rotation speed and the rotation direction (forward rotation or backward rotation) of the motor 22, and detects an actual rotation speed of the motor 22. A pressure gauge (omitted from the drawings) that measures the internal pressure is arranged inside of the nozzle 23, and measurement results thereof are outputted to the control apparatus 11.

The pump 21 of the application apparatus 20 is connected to a fluid draw-up apparatus 24 through a pipe 25 (example: a flexible hose). The fluid draw-up apparatus 24 draws up the fluid (omitted from the drawings) stored in a container 26 such as a drum, and supplies the drawn-up fluid to the pump 21 through the pipe 25.

The movement apparatus 30 includes an articulated robot 31 and a robot controller 32 that controls an operation of the articulated robot 31. The application apparatus 20 is attached to the leading end of an arm provided to the articulated robot 31. In the fluid application system 10 illustrated in FIG. 6, the workpiece is fixed whereas the pump 21 is moved by the articulated robot 31. This achieves relative movement between the application apparatus 20 and the workpiece. The robot controller 32 is connected to the articulated robot 31 and the control apparatus 11 by cables. The robot controller 32 outputs an operation signal to the articulated robot 31 in accordance with an input from the control apparatus 11, and outputs the movement speed, position information, and the like of the articulated robot 31 to the control apparatus 11.

The control apparatus 11 adjusts the output of the pump 21 (power source) considering the internal pressure of the nozzle 23, and controls the discharge amount of the fluid from the nozzle 23 and the variation amount of the discharge amount thereof.

[Discharge Amount Control]

Discharge amount control according to the present embodiment is intended for the case where the output of the power source is adjusted in the course from application start up to application end and where the discharge amount of the fluid per unit time from the nozzle is varied by a target variation amount by this adjustment. Here, the target variation amount refers to the difference between the discharge amount after the variation and the discharge amount before the variation.

Note that, at the time of the application start and the time of the application end, the discharge amount may be controlled according to a conventional general method. Moreover, discharge amount control at the time of the application start and the time of the application end may be implemented in the control apparatus 11 included in the fluid application system of the present embodiment.

Specifically, the case where the discharge amount is varied in the course from the application start up to the application end corresponds to the case where the discharge amount is varied in accordance with a change in the movement speed of the nozzle with respect to the workpiece when the fluid is applied to the workpiece such that the line width of the applied fluid is constant. In addition, this case corresponds to the case where the discharge amount is varied in accordance with a change in the line width of the applied fluid when the fluid is applied while the movement speed of the nozzle with respect to the workpiece is made constant.

Here, if the behavior of the power source is in a stable state, the discharge amount from the nozzle has a positive correlation with the internal pressure of the nozzle, and the discharge amount from the nozzle increases as the internal pressure of the nozzle increases. With the use of such a positive correlation, in the discharge amount control according to the present embodiment, an amount by which the internal pressure of the nozzle needs to change is obtained from the target variation amount of the discharge amount.

Moreover, as described above, if the behavior of the power source is in a stable state, the discharge amount from the nozzle has a positive correlation with the output of the power source, and the discharge amount from the nozzle increases as the output of the power source increases. With the use of such a positive correlation, in the discharge amount control according to the present embodiment, a theoretical output of the power source obtained from the target variation amount of the discharge amount is obtained. The theoretical output of the power source obtained from the target variation amount of the discharge amount refers to the output of the power source at which the discharge amount after variation by the target variation amount is obtained in a stable state of the behavior of the power source.

Then, in the discharge amount control according to the present embodiment, the output of the power source is set to a value beyond the theoretical output and is then set to the theoretical output such that the change amount of the internal pressure of the nozzle is coincident with the amount by which the internal pressure of the nozzle needs to change. In this way, the output of the power source is set to the value beyond the theoretical output, in other words, the output of the power source is temporarily excessively adjusted, whereby the time required for the change in the internal pressure of the nozzle can be shortened. Moreover, the output of the power source is adjusted such that the amount by which the internal pressure of the nozzle needs to change is achieved, whereby the variation amount of the discharge amount can be prevented from overshooting or undershooting from the target variation amount. As a result, a response delay in the discharge amount from the nozzle can be suppressed, and the variation amount of the discharge amount can be controlled to the target variation amount.

Hereinafter, with reference to the drawings, description is given of: an embodiment (hereinafter, also referred to as the "first embodiment") in which the discharge amount is varied in accordance with a change in the movement speed of the nozzle when the fluid is applied to the workpiece such that the line width of the applied fluid is constant; and an embodiment (hereinafter, also referred to as the "second embodiment") in which the discharge amount is varied in accordance with a change in the line width of the applied fluid when the fluid is applied while the movement speed is made constant.

First Embodiment

Figure 1:
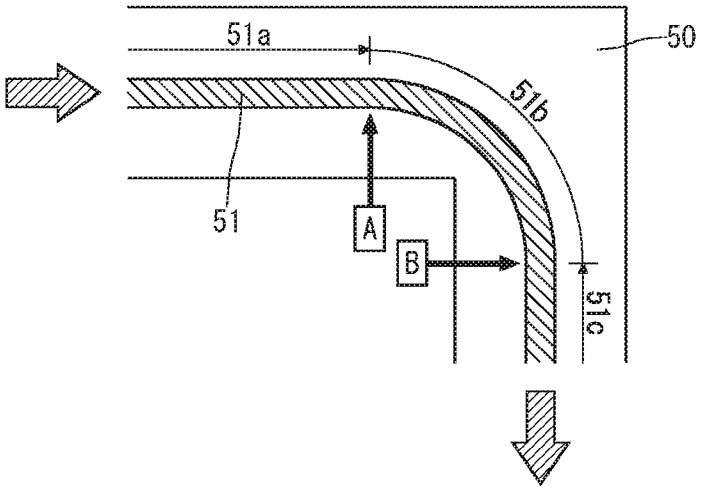
FIG.1 (PRIOR ART)
FIG. 1 is a schematic diagram illustrating the form of a fluid that is applied to a workpiece in the case where movement of a nozzle with respect to the workpiece is performed in order of a linear manner, an arc-like manner, and a linear manner.
Figure 2A:
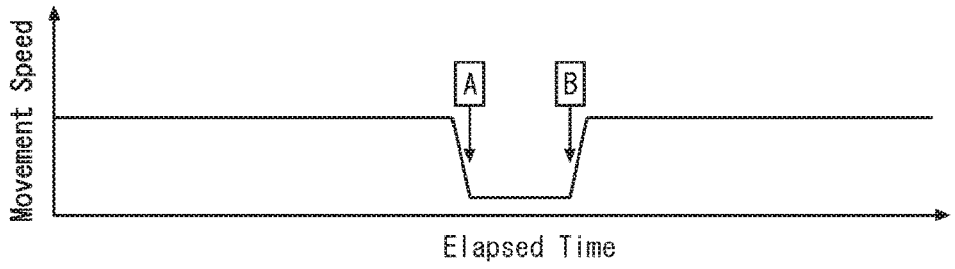
FIG.2A (PRIOR ART)
FIG. 2A is a schematic diagram illustrating an example of control in the case of changing the movement speed of the nozzle when the movement of the nozzle with respect to the workpiece is performed in order of a linear manner, an arc-like manner, and a linear manner, and illustrates the relation between the elapsed time and the movement speed.
Figure 7A:
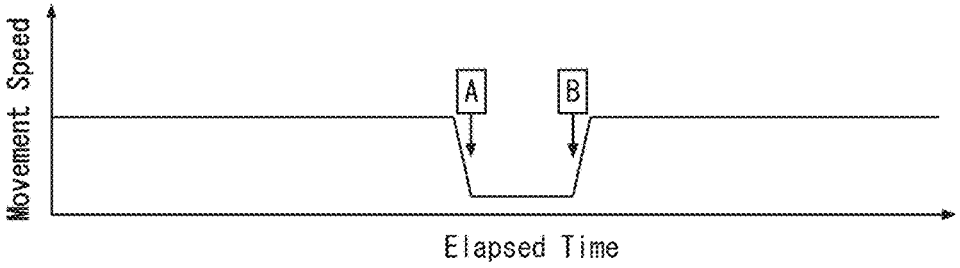
FIG. 7A is a schematic diagram illustrating an example of discharge amount control according to a first embodiment of the present invention, and illustrates the relation between the elapsed time and the movement speed.
Figure 7B:
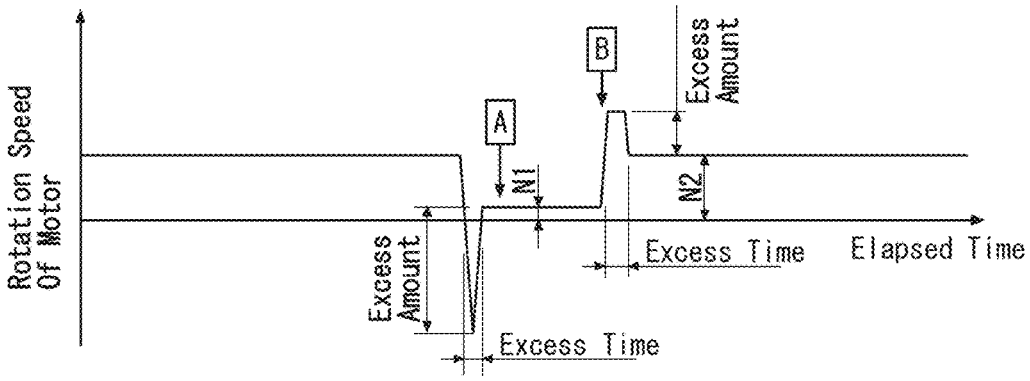
FIG. 7B is a schematic diagram illustrating an example of the discharge amount control according to the first embodiment of the present invention, and illustrates the relation between the elapsed time and the rotation speed of a motor (power source) of an application apparatus.
Figure 7C:
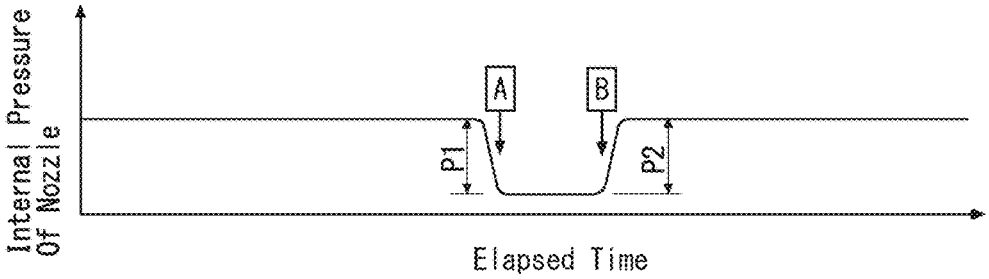
FIG. 7C is a schematic diagram illustrating an example of the discharge amount control according to the first embodiment of the present invention, and illustrates the relation between the elapsed time and the internal pressure of a nozzle.
Figure 7D:
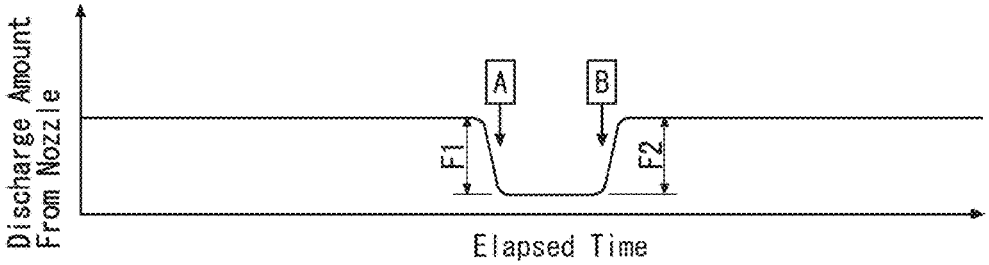
FIG. 7D is a schematic diagram illustrating an example of the discharge amount control according to the first embodiment of the present invention, and illustrates the relation between the elapsed time and the discharge amount from the nozzle.
Figure 7E:
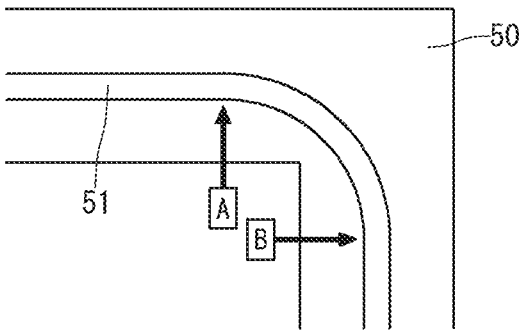
FIG. 7E is a schematic diagram illustrating an example of the discharge amount control according to the first embodiment of the present invention, and illustrates the form of an applied fluid on a workpiece.

FIG. 7A to FIG. 7E are schematic diagrams illustrating an example of discharge amount control according to the first embodiment of the present invention. Of these drawings, FIG. 7A illustrates the relation between the elapsed time and the movement speed. FIG. 7B illustrates the relation between the elapsed time and the rotation speed of the motor (power source) of the application apparatus. FIG. 7C illustrates the relation between the elapsed time and the internal pressure of the nozzle. FIG. 7D illustrates the relation between the elapsed time and the discharge amount from the nozzle. FIG. 7E illustrates the form of the applied fluid on the workpiece. FIG. 7A to FIG. 7E illustrate the situation where such an applied fluid made of the first linear part 51*a*, the arc-like part 51*b*, and the second linear part 51*c* as illustrated in FIG. 1 is formed. A position A and a position B illustrated in FIG. 7A to FIG. 7E respectively correspond to the position A and the position B illustrated in FIG. 1 and FIG. 2A to FIG. 2D. The situation illustrated in FIG. 7A to FIG. 7E is the situation where the fluid is applied using the fluid application system illustrated in FIG. 6 while a relation between the elapsed time and the movement speed similar to that in FIG. 2A is secured as illustrated in FIG. 7A.

As illustrated in FIG. 7A, the movement speed of the nozzle with respect to the workpiece decreases in the vicinity of the position A. At this time, in order to make the line width of the fluid applied to the workpiece constant, as illustrated in FIG. 7B, it is necessary to decrease the output of the power source (the rotation speed of the motor) in accordance with the decrease in the movement speed of the nozzle and thus decrease the discharge amount by a target variation amount F1 (see FIG. 7D).

In the discharge amount control according to the present embodiment, with the use of the relation between the internal pressure of the nozzle and the discharge amount from the nozzle, an amount P (see FIG. 7C) by which the internal pressure of the nozzle needs to drop is obtained from the target variation amount F1 of the discharge amount. Moreover, with the use of the relation between the rotation speed of the motor (the output of the power source) and the discharge amount from the nozzle, a theoretical rotation speed (output) N1 of the power source is obtained from the target variation amount F1 of the discharge amount. Then, the rotation speed of the motor (the output of the power source) is decreased beyond the theoretical rotation speed (output) N1 and is then set to the theoretical rotation speed (output) N1 (see FIG. 7B) such that the change amount of the internal pressure of the nozzle is coincident with the amount P1 by which the internal pressure thereof needs to drop. Consequently, a response delay in the discharge amount can be suppressed, and the line width of the applied fluid can be kept constant as illustrated in FIG. 7E.

Moreover, as illustrated in FIG. 7A, the movement speed of the nozzle with respect to the workpiece increases in the vicinity of the position B. At this time, in order to make the line width of the fluid applied to the workpiece constant, as illustrated in FIG. 7B, it is necessary to increase the output of the power source (the rotation speed of the motor) in accordance with the increase in the movement speed of the nozzle and thus increase the discharge amount by a target variation amount F2 (see FIG. 7D).

In the discharge amount control according to the present embodiment, with the use of the relation between the internal pressure of the nozzle and the discharge amount from the nozzle, an amount P2 (see FIG. 7C) by which the internal pressure of the nozzle needs to rise is obtained from the target variation amount F2 of the discharge amount. Moreover, with the use of the relation between the rotation speed of the motor (the output of the power source) and the discharge amount from the nozzle, a theoretical rotation speed (output) N2 of the power source is obtained from the target variation amount F2 of the discharge amount. Then, the rotation speed of the motor (the output of the power source) is increased beyond the theoretical rotation speed (output) N2 and is then set to the theoretical rotation speed (output) N2 (see FIG. 7B) such that the change amount of the internal pressure of the nozzle is coincident with the amount P2 by which the internal pressure thereof needs to rise. Consequently, a response delay in the discharge amount can be suppressed, and the line width of the applied fluid can be kept constant as illustrated in FIG. 7E.

The first embodiment as described above is not limited to the case example where the movement speed of the nozzle is decelerated in the region of the arc-like part 51*b* at the time of applying the fluid made of the first linear part 51*a*, the arc-like part 51*b*, and the second linear part 51*c*. That is, the above-mentioned control can be applied to any case examples where the movement speed of the nozzle is changed in the course from application start up to application end when the fluid is applied to the workpiece such that the line width of the applied fluid is constant. For example, the control of the present embodiment can also be applied to a case example where the movement speed is increased or decreased in a middle region at the time of applying a fluid made of only a linear part. Moreover, at the time of applying a fluid made of a first arc-like part and a second arc-like part having a radius different from that of the first arc-like part, the movement speed is increased or decreased in a connection portion between the region of the first arc-like part and the region of the second arc-like part. The control of the present embodiment can also be applied to such a case example.

Second Embodiment

Figure 3:
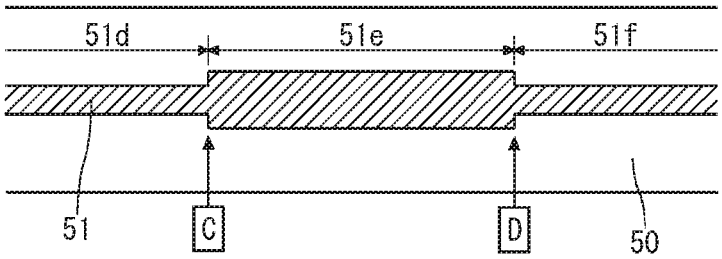
FIG.3 (PRIOR ART)
FIG. 3 is a schematic diagram illustrating the form of the fluid that is applied to the workpiece in the case where the line width thereof changes halfway.
Figure 4A:
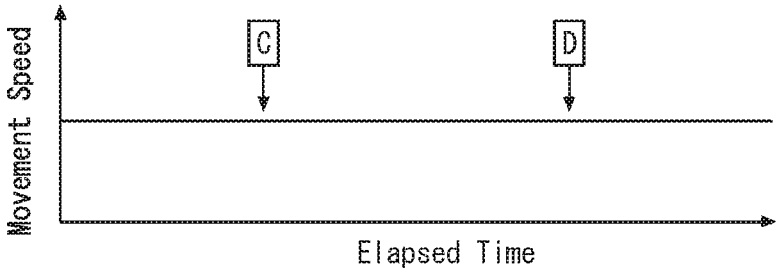
FIG. 4A is a diagram illustrating an example of control when the fluid is applied at a time in the case where the line width thereof changes halfway, and illustrates the relation between the elapsed time and the movement speed.
Figure 4B:
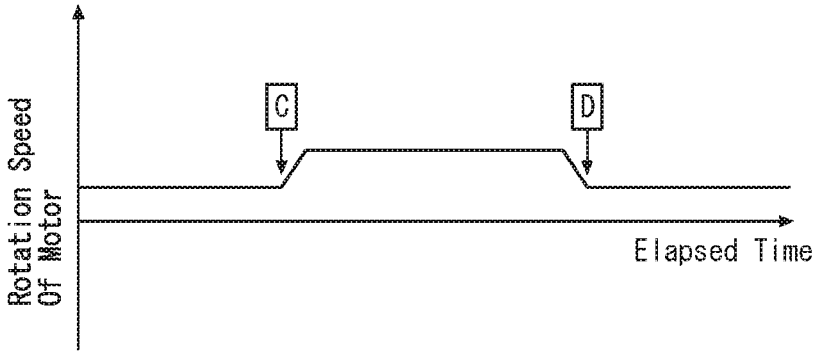
FIG. 4B is a diagram illustrating an example of the control when the fluid is applied at a time in the case where the line width thereof changes halfway, and illustrates the relation between the elapsed time and the rotation speed of the motor (power source) of the application apparatus.
Figure 4C:
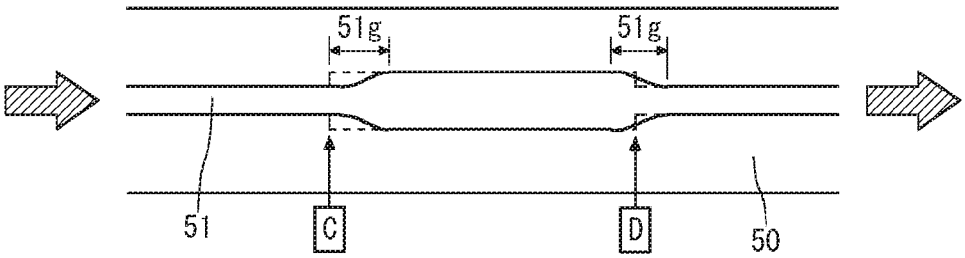
FIG. 4C is a diagram illustrating an example of the control when the fluid is applied at a time in the case where the line width thereof changes halfway, and illustrates the form of the applied fluid on the workpiece.
Figure 8A:
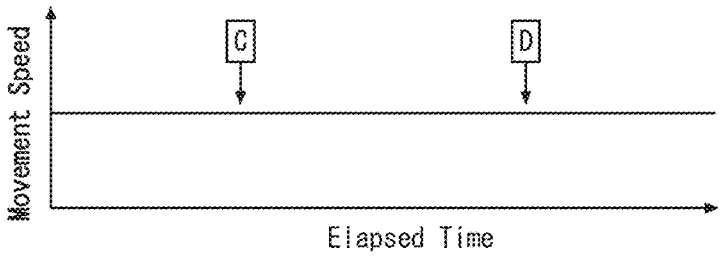
FIG. 8A is a schematic diagram illustrating an example of discharge amount control according to a second embodiment of the present invention, and illustrates the relation between the elapsed time and the movement speed.
Figure 8B:
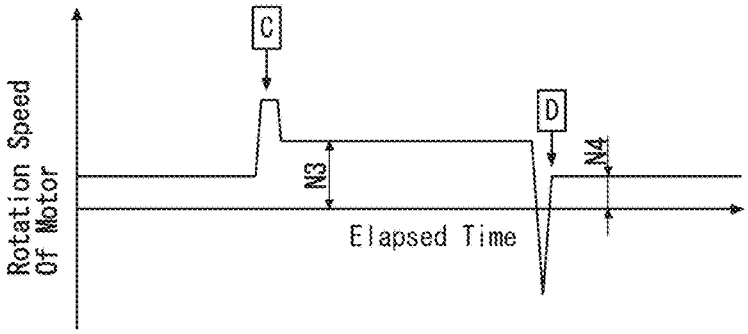
FIG. 8B is a schematic diagram illustrating an example of the discharge amount control according to the second embodiment of the present invention, and illustrates the relation between the elapsed time and the rotation speed of a motor (power source) of an application apparatus.
Figure 8C:
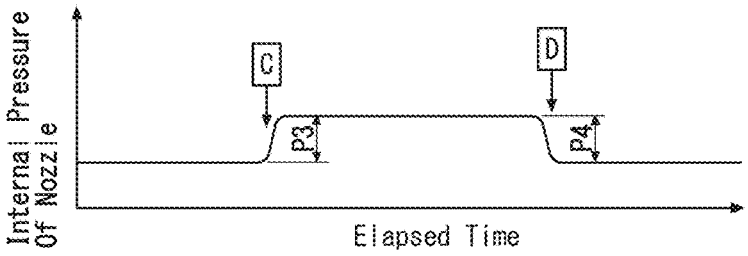
FIG. 8C is a schematic diagram illustrating an example of the discharge amount control according to the second embodiment of the present invention, and illustrates the relation between the elapsed time and the internal pressure of a nozzle.
Figure 8D:
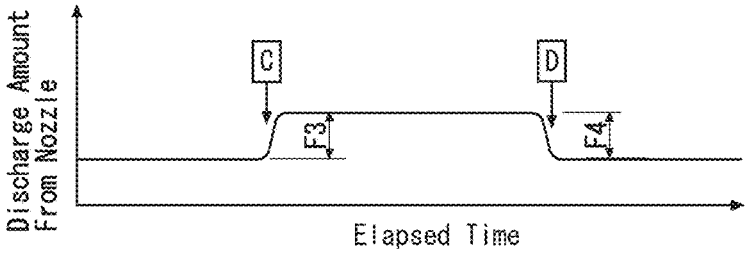
FIG. 8D is a schematic diagram illustrating an example of the discharge amount control according to the second embodiment of the present invention, and illustrates the relation between the elapsed time and the discharge amount from the nozzle.
Figure 8E:
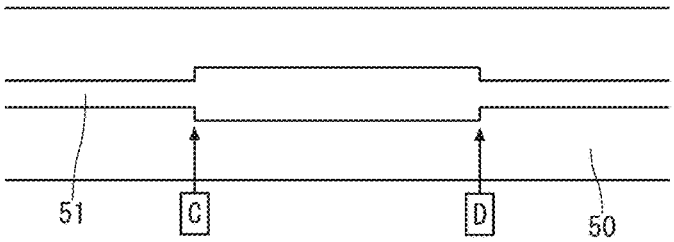
FIG. 8E is a schematic diagram illustrating an example of the discharge amount control according to the second embodiment of the present invention, and illustrates the form of an applied fluid on a workpiece.

FIG. 8A to FIG. 8E are schematic diagrams illustrating an example of discharge amount control according to the second embodiment of the present invention. Of these drawings, FIG. 8A illustrates the relation between the elapsed time and the movement speed. FIG. 8B illustrates the relation between the elapsed time and the rotation speed of the motor (power source) of the application apparatus. FIG. 8C illustrates the relation between the elapsed time and the internal pressure of the nozzle. FIG. 8D illustrates the relation between the elapsed time and the discharge amount from the nozzle. FIG. 8E illustrates the form of the applied fluid on the workpiece. FIG. 8A to FIG. 8E illustrate the situation where such an applied fluid made of the first thin line part 51*d*, the thick line part 51*e*, and the second thin line part 51*f* as illustrated in FIG. 3 is formed. A position C and a position D illustrated in FIG. 8A to FIG. 8E respectively correspond to the position C and the position D illustrated in FIG. 3 and FIG. 4A to FIG. 4C. The situation illustrated in FIG. 8A to FIG. 8E is the situation where the fluid is applied using the fluid application system illustrated in FIG. 6 while a relation between the elapsed time and the movement speed similar to that in FIG. 4A is secured as illustrated in FIG. 8A.

As illustrated in FIG. 8E, the line width of the fluid 51 applied to the workpiece 50 becomes thinner in the vicinity of the position D. In order to make the line width of the fluid applied to the workpiece thinner, as illustrated in FIG. 8B, it is necessary to decrease the output of the power source (the rotation speed of the motor) and thus decrease the discharge amount by a target variation amount F4 (see FIG. 8D).

In the discharge amount control according to the present embodiment, with the use of the relation between the internal pressure of the nozzle and the discharge amount from the nozzle, an amount P4 (see FIG. 8C) by which the internal pressure of the nozzle needs to drop is obtained from the target variation amount F4 of the discharge amount. Moreover, with the use of the relation between the rotation speed of the motor (the output of the power source) and the discharge amount from the nozzle, a theoretical rotation speed (output) N4 of the power source is obtained from the target variation amount F4 of the discharge amount. Then, the rotation speed of the motor (the output of the power source) is decreased beyond the theoretical rotation speed (output) N4 and is then set to the theoretical rotation speed (output) N4 (see FIG. 8B) such that the change amount of the internal pressure of the nozzle is coincident with the amount P4 by which the internal pressure thereof needs to drop. Consequently, a response delay in the discharge amount can be suppressed, and, when the line width of the applied fluid is made thinner, a portion in which the line width indistinctly changes can be prevented from being formed at the boundary between the thick line part and the thin line part, as illustrated in FIG. 8E.

Moreover, as illustrated in FIG. 8E, the line width of the fluid 51 applied to the workpiece 50 becomes thicker in the vicinity of the position C. In order to make the line width of the fluid applied to the workpiece thicker, as illustrated in FIG. 8B, it is necessary to increase the output of the power source (the rotation speed of the motor) and thus increase the discharge amount by a target variation amount F3 (see FIG. 8D).

In the discharge amount control according to the present embodiment, with the use of the relation between the internal pressure of the nozzle and the discharge amount from the nozzle, an amount P3 (see FIG. 8C) by which the internal pressure of the nozzle needs to rise is obtained from the target variation amount F3 of the discharge amount. Moreover, with the use of the relation between the rotation speed of the motor (the output of the power source) and the discharge amount from the nozzle, a theoretical rotation speed (output) N3 of the power source is obtained from the target variation amount F3 of the discharge amount. Then, the rotation speed of the motor (the output of the power source) is increased beyond the theoretical rotation speed (output) N3 and is then set to the theoretical rotation speed (output) N3 (see FIG. 8B) such that the change amount of the internal pressure of the nozzle is coincident with the amount P3 by which the internal pressure thereof needs to rise. Consequently, a response delay in the discharge amount can be suppressed, and, when the line width of the applied fluid is made thicker, a portion in which the line width indistinctly changes can be prevented from being formed at the boundary between the thin line part and the thick line part, as illustrated in FIG. 8E.

At the time of forming an applied fluid including thin line parts and a thick line part, the discharge amount control according to the present embodiment as described above enables the fluid to be continuously applied at a time. Hence, nozzle replacement is unnecessary, with the results that the manufacture efficiency can be enhanced and that equipment costs required for a nozzle replacement apparatus can be reduced.

In the second embodiment, the form of the applied fluid is angulated at the boundary between each thin line part and the thick line part as illustrated in FIG. 3 and FIG. 8E. The applied fluid having such an angulated shape at each boundary can be formed using such a rectangular flat nozzle having a wide discharge port as described above. However, the second embodiment is not limited to the case of forming the applied fluid having the angulated shape at each boundary. That is, the present embodiment can also be applied to the case of forming an applied fluid having a rounded shape at each boundary using a round nozzle having a circular discharge port.

[Adjustment of Excess Amount, Excess Time, and the Like]

In the discharge amount control according to the present embodiment, as described above, the output of the power source is set to a value beyond a theoretical output and is then set to the theoretical output. On this occasion, as the vicinity of the position A illustrated in FIG. 7B, the output of the power source may be varied beyond a theoretical output by an excess amount and may then be promptly set to the theoretical output. Moreover, as the vicinity of the position B illustrated in FIG. 7B, the output of the power source may be varied beyond a theoretical output by an excess amount, may then be kept at the resultant output for a while, and may then be set to the theoretical output.

In the discharge amount control according to the present embodiment, control conditions such as the change start position, the excess amount, and the excess time of the output of the power source are adjusted, whereby the change amount of the internal pressure of the nozzle is changed to the amount by which the internal pressure of the nozzle needs to change. Control conditions for making the change amount of the internal pressure of the nozzle coincident with the amount by which the internal pressure of the nozzle needs to change will change depending on various conditions such as the discharge amount, the variation amount thereof, the inner diameter of the discharge port of the nozzle, the viscosity of the fluid, and characteristics of the pump (fluid supply apparatus). In the case of changing these various conditions, the control conditions are adjusted as appropriate, whereby these various conditions are changed such that the change amount of the internal pressure of the nozzle is coincident with the amount by which the internal pressure of the nozzle needs to change.

On this occasion, for example, in the case where the internal pressure of the nozzle changes beyond the amount by which the internal pressure of the nozzle needs to change, such adjustment that decreases any one or both of the excess amount and the excess time is performed. On the other hand, in the case where the internal pressure of the nozzle does not reach the amount by which the internal pressure of the nozzle needs to change, such adjustment that increases any one or both of the excess amount and the excess time is performed. Moreover, the change start position of the output of the power source may be adjusted such that the change completion position of the internal pressure of the nozzle is coincident with the change completion position of the movement speed of the nozzle or the change completion position of the line width of the applied fluid.

[Preferable Modes]

Hereinafter, preferable modes of the fluid application system and the fluid application method of the present embodiment are described.

In the fluid application system and the fluid application method of the present embodiment, an adhesive agent, a sealing agent, an insulating agent, a heat releasing agent, an anti-seizure agent, and the like can be used as the fluid. It is preferable that such a fluid be a compressible fluid. If the fluid is compressible, a squeezing effect becomes higher, so that a response delay in the discharge amount becomes more noticeable. In this regard, even if the compressible fluid is used, a response delay in the discharge amount can be suppressed by applying the present embodiment. The compressible fluid includes, for example, a liquid epoxy resin or a liquid silicone resin, and also includes fluids having a compressibility equivalent to those of these resins.

In the fluid application system illustrated in FIG. 6, the pump that changes the supply amount of the fluid per unit time in accordance with the rotation speed of the motor is used as the fluid supply apparatus. For example, a uniaxial eccentric screw pump, a gear pump, or a rotary pump can be adopted as the pump. In addition, for example, a solenoid pump including a motion element that moves due to an excitation action of a solenoid can also be used thereas. The solenoid serves as a power source of the solenoid pump, and the solenoid pump changes its supply amount in accordance with the operation cycle of the solenoid.

Each of such fluid supply apparatuses includes: a motion element that makes a motion in accordance with the output of a power source; and a space formation member that forms a space for housing the motion element and sending out a fluid along with the motion of the motion element. For example, if the fluid supply apparatus is a gear pump, a gear corresponds to the motion element, and a casing or the like that forms a pump chamber corresponds to the space formation member. If the fluid supply apparatus is a rotary pump, a rotor corresponds to the motion element, and a casing or the like that forms a pump chamber corresponds to the space formation member. If the fluid supply apparatus is a piston pump, a piston corresponds to the motion element, and a cylinder corresponds to the space formation member.

Here, when the discharge amount from the nozzle is changed by adjusting the output of the power source, as described above, the internal pressure of the nozzle changes as a result. The nozzle deforms along with the change in the internal pressure, and the volume of a space filled with the fluid changes inside of the nozzle. Moreover, when the discharge amount from the nozzle is changed by adjusting the output of the power source, the internal pressure of a member upstream of the nozzle, specifically, the space formation member such as the pump chamber also changes as a result. Hence, the space formation member deforms, and the volume of the space filled with the fluid changes inside of the space formation member.

A response delay in the discharge amount from the nozzle is encouraged by such deformation of the nozzle or the space formation member. The discharge amount control of the present embodiment can deal with such a circumstance.

In the fluid application system of the present embodiment, a uniaxial eccentric screw pump can be adopted as the fluid supply apparatus. The uniaxial eccentric screw pump includes: a male-threaded rotor that eccentrically rotates in accordance with the output of a power source (motor); and a female-threaded stator that houses the rotor. In the uniaxial eccentric screw pump, the rotor corresponds to the motion element, and the stator corresponds to the space formation member.

Figure 9:
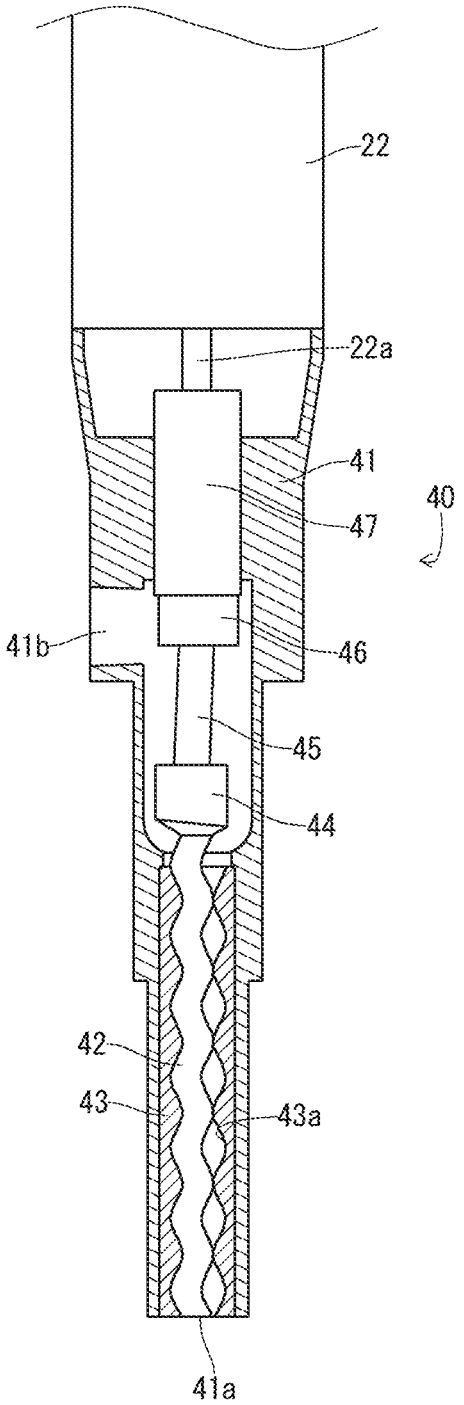
FIG. 9 is a cross-sectional view schematically illustrating the configuration of a uniaxial eccentric screw pump preferably used as a fluid supply apparatus.

FIG. 9 is a cross-sectional view schematically illustrating the configuration of a uniaxial eccentric screw pump preferably used as the fluid supply apparatus. A uniaxial eccentric screw pump 40 illustrated in FIG. 9 includes: a male-threaded rotor 42 that receives power from the motor 22 to eccentrically rotate; and a female-threaded stator 43 having an inner circumferential surface on which female thread is formed. The rotor 42 and the stator 43 as described above are housed inside of a casing 41. The casing 41 is a tubular member made of metal, and a first opening part 41*a* is provided at the leading end in the longitudinal direction of the casing 41. The first opening part 41*a* functions as a discharge port of the uniaxial eccentric screw pump 40, and the nozzle for discharging the fluid to the workpiece is attached to the discharge port.

Moreover, a second opening part 41*b* is provided in an outer circumferential portion of the casing 41. The second opening part 41*b* is communicated with the internal space of the casing 41 in a middle part in the longitudinal direction of the casing 41. The second opening part 41*b* functions as a suction port of the uniaxial eccentric screw pump 40, and is connected to the above-mentioned fluid draw-up apparatus through a pipe.

The stator 43 is made of an elastic body (such as rubber), resin, or the like. Female thread comprising a n-start thread is formed in an inner hole 43*a* of the stator 43. In comparison, the rotor 42 is a shaft body made of metal, and male thread comprising a (n−1)-start thread is formed on the outer circumference of the rotor 42.

In the uniaxial eccentric screw pump 40 illustrated in FIG. 9, the stator 43 has a double-start female thread, and the cross-section of the inner hole 43*a* of the stator 43 is substantially oval at any position in the longitudinal direction. Meanwhile, the rotor 42 has a single-start male thread, and the cross-section of the rotor 42 is substantially perfectly circular at any position in the longitudinal direction. The rotor 42 is inserted through the inner hole 43*a* formed in the stator 43, and is made freely eccentrically rotatable inside of the inner hole 43*a*.

In order to make the rotor 42 eccentrically rotatable, the rotor 42 is coupled to a rod 45 through a first universal joint 44, and the rod 45 is coupled to a drive shaft 47 through a second universal joint 46. The drive shaft 47 is rotatably held by the casing 41 in the state where a gap with the casing 41 is sealed. The drive shaft 47 is coupled to a main shaft 22*a* of the motor 22. Hence, the main shaft 22*a* rotates due to an operation of the motor 22, the drive shaft 47 rotates accordingly, and further the rotor 42 eccentrically rotates through the universal joints 44 and 46 and the rod 45.

If the rotor 42 rotates inside of the stator 43, the space formed between the outer circumferential surface of the rotor 42 and the inner hole 43*a* of the stator moves in the longitudinal direction of the stator 43 while spirally rotating inside of the stator 43. Hence, if the rotor 42 rotates, the fluid is suctioned from one end of the stator 43, and, at the same time, the suctioned fluid is fed toward another end of the stator 43. In the uniaxial eccentric screw pump 40 illustrated in FIG. 9, if the rotor 42 is rotated in the forward direction, the fluid suctioned from the second opening part 41*b* is fed under pressure, and is discharged from the first opening part 41*a*.

The uniaxial eccentric screw pump as described above can freely and accurately change the supply amount of the fluid by controlling rotations of the power source (motor) thereof. Hence, in the case where the fluid supply apparatus is the uniaxial eccentric screw pump, if the rotation speed of the motor is in a stable state, fluctuations in the line width can be suppressed in a region to which the fluid is applied.

Moreover, in the uniaxial eccentric screw pump, because the stator 43 corresponding to the above-mentioned space formation member is made of an elastic body (such as rubber), resin, or the like, the stator 43 easily deforms along with a change in the internal pressure. Hence, resulting from a change in the volume of the space filled with the fluid inside of the nozzle, a response delay in the discharge amount from the nozzle is easily encouraged. In this regard, even in the case of the uniaxial eccentric screw pump, the discharge amount control of the present embodiment can suppress a response delay in the discharge amount.

In the fluid application system of the present embodiment, the movement apparatus that relatively moves the application apparatus and the workpiece is not limited to the articulated robot 31 as illustrated in FIG. 6. The movement apparatus can be configured using, for example, a Z-axis direction transfer apparatus that transfers the application apparatus in a Z-axis direction, a Y-axis direction transfer apparatus that transfers the Z-axis direction transfer apparatus in a Y-axis direction, an X-axis direction transfer apparatus that transfers the Y-axis direction transfer apparatus in an X-axis direction, and a control apparatus that controls these apparatuses.

In the case of forming the applied fluid made of the first linear part 51*a*, the arc-like part 51*b*, and the second linear part 51*c* illustrated in FIG. 1, if the articulated robot 31 is adopted as the movement apparatus that moves the application apparatus 20 as illustrated in FIG. 6, deceleration in the region of the arc-like part tends to be rapid. Even in the case of the articulated robot 31 as described above, the discharge amount control of the present embodiment can suppress a response delay in the discharge amount, so that the line width of the applied fluid can be made constant.

EXAMPLE

A test in which the fluid was applied to the workpiece was conducted using the fluid application system of the present embodiment.

[Test Conditions]

In this test, the applied fluid made of the first linear part, the arc-like part, and the second linear part illustrated in FIG. 1 was formed on the workpiece. The target value of the line width of the applied fluid was set to be constant at 0.7 mm, and the radius of the arc-like part was set to 10 mm or 5 mm. The fluid application system illustrated in FIG. 6 was used to apply the fluid to the workpiece. The uniaxial eccentric screw pump illustrated in FIG. 9 was used as the application apparatus. A sealing agent was used as the fluid, and the sealing agent had a viscosity of 217,800 mPa·s at 35° C.

The movement speed was changed as illustrated in FIG. 2A and FIG. 7A, the movement speed at the time of application to the regions of the linear parts was set to 500 mm/sec, and the movement speed at the time of application to the region of the arc-like part was set to 30 mm/sec. In a stable state of the rotation speed of the motor, for the regions of the linear parts, the line width became the above-mentioned target value when the discharge amount was 0.192 mL/sec, the internal pressure of the nozzle at this discharge amount was 2.9 MPa, and the rotation speed of the motor at which this discharge amount was obtained was 9 $min^{-1}$ (rpm). Moreover, for the region of the arc-like part, the line width became the above-mentioned target value when the discharge amount was 0.012 mL/sec, the internal pressure of the nozzle at this discharge amount was 0.48 MPa, and the rotation speed of the motor at which this discharge amount was obtained was 0.36 $min^{-1}$ (rpm).

In an example of the present invention, when the discharge amount was decreased by the target variation amount (F1 (see FIG. 7D): 0.18 mL/sec), the rotation speed of the motor was decreased beyond the theoretical rotation speed (N1 (see FIG. 7B): 0.36 $min^{-1}$) and was then set to the theoretical rotation speed (N1: 0.36 $min^{-1}$) such that the change amount of the internal pressure of the nozzle is coincident with the amount (P1 (see FIG. 7C): 2.42 MPa) by which the internal pressure of the nozzle needs to drop. Specifically, the rotation speed of the motor was decreased beyond the theoretical rotation speed by an excess amount of 100 $min^{-1}$ to be thereby reversed, was then kept at the resultant rotation speed for 0.03 seconds, and was then set to the theoretical rotation speed.

Further, when the discharge amount was increased by the target variation amount (F2 (see FIG. 7D): 0.18 mL/sec), the rotation speed of the motor was increased beyond the theoretical rotation speed (N2: 9 $min^{-1}$) and was then set to the theoretical rotation speed (N2 (see FIG. 7B): 9 $min^{-1}$) such that the change amount of the internal pressure of the nozzle is coincident with the amount (P2 (see FIG. 7C): 2.42 MPa) by which the internal pressure of the nozzle needs to rise. Specifically, the rotation speed of the motor was increased beyond the theoretical rotation speed by an excess amount of 26 $min^{-1}$, was then kept at the resultant rotation speed for 0.10 seconds, and was then set to the theoretical rotation speed.

Figure 2B:
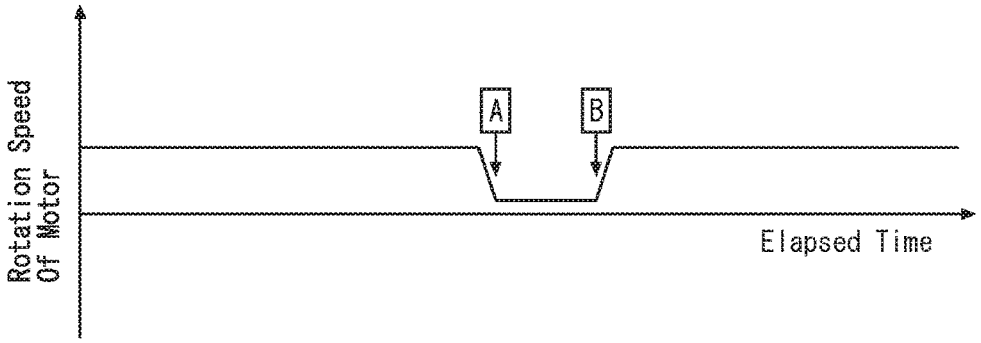
FIG.2B (PRIOR ART)
FIG. 2B is a schematic diagram illustrating an example of the control in the case of changing the movement speed of the nozzle when the movement of the nozzle with respect to the workpiece is performed in order of a linear manner, an arc-like manner, and a linear manner, and illustrates the relation between the elapsed time and the rotation speed of a motor (power source) of an application apparatus.
Figure 2C:
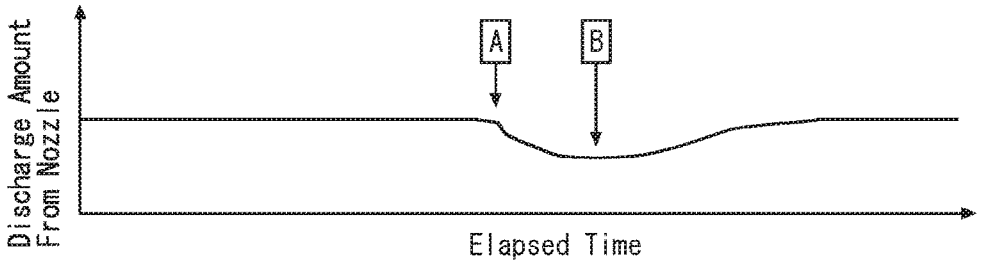
FIG.2C (PRIOR ART)
FIG. 2C is a schematic diagram illustrating an example of the control in the case of changing the movement speed of the nozzle when the movement of the nozzle with respect to the workpiece is performed in order of a linear manner, an arc-like manner, and a linear manner, and illustrates the relation between the elapsed time and the discharge amount from the nozzle.
Figure 2D:
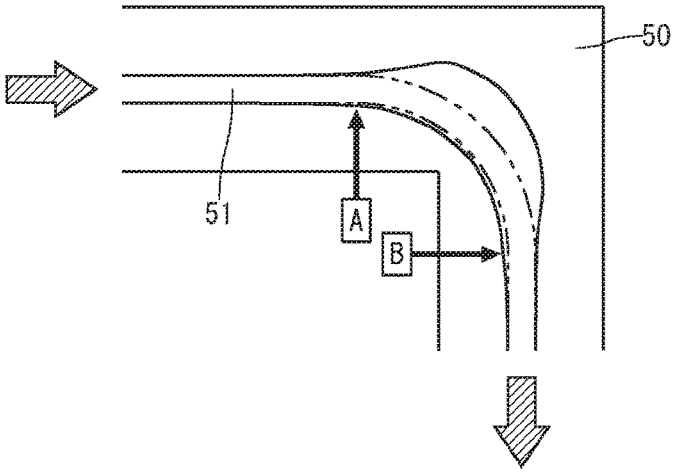
FIG.2D (PRIOR ART)
FIG. 2D is a schematic diagram illustrating an example of the control in the case of changing the movement speed of the nozzle when the movement of the nozzle with respect to the workpiece is performed in order of a linear manner, an arc-like manner, and a linear manner, and illustrates the form of the applied fluid on the workpiece.

In a comparative example, as illustrated in FIG. 2B, the rotation speed of the motor was changed in accordance with the movement speed. For the regions of the linear parts, the rotation speed of the motor was set to 9 $min^{-1}$ (rpm). For the region of the arc-like part, the rotation speed of the motor was set to 0.36 $min^{-1}$ (rpm).

[Test Results]

Figure 10A:
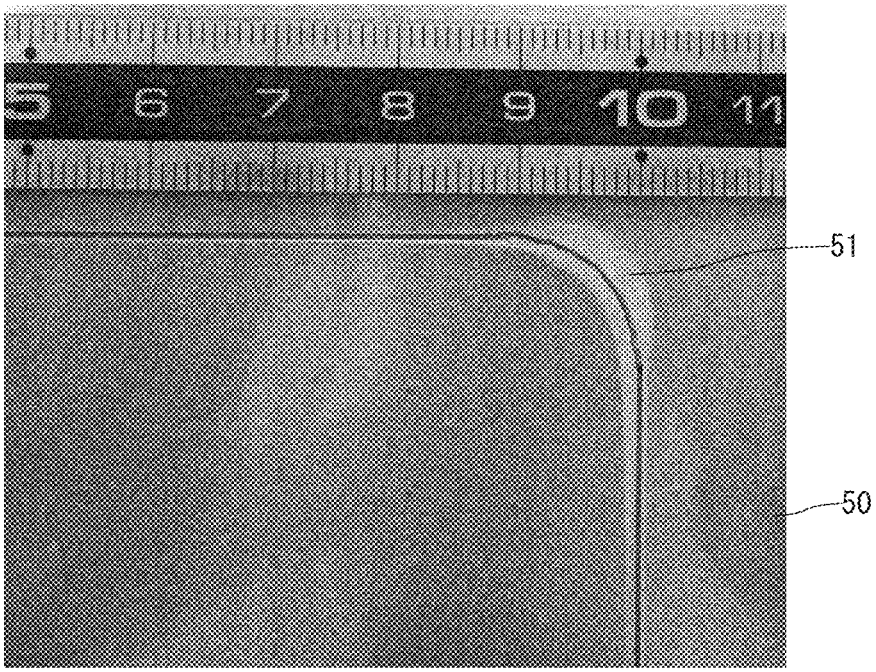
FIG. 10A is a diagram illustrating a test result of a comparative example.
Figure 10B:
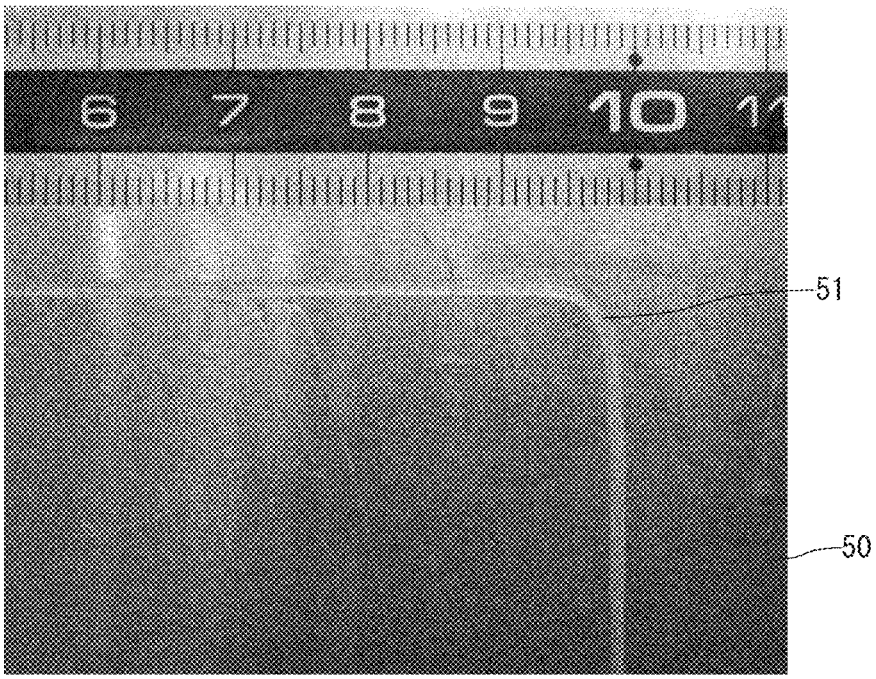
FIG. 10B is a diagram illustrating a test result of an example of the present invention.

FIG. 10A is a diagram illustrating a test result of the comparative example, and FIG. 10B is a diagram illustrating a test result of the example of the present invention. These diagrams are photographs each obtained by taking the fluid 51 applied onto the workpiece 50. As illustrated in FIG. 10A, in the comparative example, the line width of the applied fluid was thicker in the arc-like part and an entrance-side portion of the second linear part due to a response delay in the discharge amount. In comparison, as illustrated in FIG. 10B, in the example of the present invention, a change in the line width due to a response delay in the discharge amount was not found, and the line width of the applied fluid was constant.

Accordingly, these results prove that the fluid application system of the present embodiment can suppress a response delay in the discharge amount from the nozzle.

INDUSTRIAL APPLICABILITY

The present invention can be effectively used to apply a fluid such as an adhesive agent, a sealing agent, an insulating agent, a heat releasing agent, and an anti-seizure agent to a workpiece, in a process of manufacturing an automobile, an electronic member, a solar cell, and the like.

REFERENCE SIGNS LIST

10: fluid application system
11: control apparatus
20: application apparatus
21: pump (fluid supply apparatus)
22: motor (power source)
22*a*: main shaft of motor
23: nozzle
24: fluid draw-up apparatus
25: pipe
26: container
30: movement apparatus
31: articulated robot
32: robot controller
40: uniaxial eccentric screw pump (fluid supply apparatus)
41: casing
41*a*: first opening part
41*b*: second opening part
42: rotor
43: stator
43*a*: inner hole
44: first universal joint
45: rod
46: second universal joint
47: drive shaft
50: workpiece
51: applied fluid
51*a*: first linear part
51*b*: arc-like part
51*c*: second linear part
51*d*: first thin line part
51*e*: thick line part
51*f*: second thin line part
51*g*: portion in which line width changes due to response delay in discharge amount

The invention claimed is:

1. A fluid application system comprising:

an application apparatus that discharges a fluid to a workpiece;

a movement apparatus that relatively moves the application apparatus and the workpiece; and a control apparatus that controls the application apparatus, wherein the application apparatus includes: a power source; a fluid supply apparatus that changes a supply amount of the fluid per unit time in accordance with an output of the power source; and a nozzle that discharges the fluid supplied from the fluid supply apparatus, to the workpiece, and from application start up to application end:

at any point when a movement speed of the nozzle with respect to the workpiece is decreasing and the output of the power source is decreasing in accordance with the decrease in the movement speed to thereby decrease the discharge amount of the fluid per unit time from the nozzle by a target variation amount such that the line width of the fluid applied to the workpiece is constant, the control apparatus decreases the output of the power source beyond a theoretical output of the power source obtained from the target variation amount of the discharge amount, and then sets the output of the power source to the theoretical output such that the change amount of the internal pressure of the nozzle is coincident with an amount by which the internal pressure of the nozzle needs to drop, the amount being obtained from the target variation amount of the discharge amount, and at any point when the movement speed of the nozzle with respect to the workpiece is increasing and the output of the power source is increasing in accordance with the increase in the movement speed to thereby increase the discharge amount of the fluid per unit time from the nozzle by a target variation amount such that the line width of the fluid applied to the workpiece is constant, the control apparatus increases the output of the power source beyond a theoretical output of the power source obtained from the target variation amount of the discharge amount, and then sets the output of the power source to the theoretical output such that the change amount of the internal pressure of the nozzle is coincident with an amount by which the internal pressure of the nozzle needs to rise, the amount being obtained from the target variation amount of the discharge amount.

2. A fluid application system comprising:

an application apparatus that discharges a fluid to a workpiece;

a movement apparatus that relatively moves the application apparatus and the workpiece; and a control apparatus that controls the application apparatus, wherein the application apparatus includes: a power source; a fluid supply apparatus that changes a supply amount of the fluid per unit time in accordance with an output of the power source; and a nozzle that discharges the fluid supplied from the fluid supply apparatus, to the workpiece, and from application start up to application end:

at any point when a movement speed of the nozzle with respect to the workpiece is constant and the output of the power source is decreasing to thereby decrease the discharge amount of the fluid per unit time from the nozzle by a target variation amount such that the line width of the fluid applied to the workpiece becomes thinner along with the decrease in the discharge amount, the control apparatus decreases the output of the power source beyond a theoretical output of the power source obtained from the target variation amount of the discharge amount, and then sets the output of the power source to the theoretical output such that the change amount of the internal pressure of the nozzle is coincident with an amount by which the internal pressure of the nozzle needs to drop, the amount being obtained from the target variation amount of the discharge amount, and at any point when the movement speed of the nozzle with respect to the workpiece is constant and the output of the power source is increasing to thereby increase the discharge amount of the fluid per unit time from the nozzle by a target variation amount such that the line width of the fluid applied to the workpiece becomes thicker along with the increase in the discharge amount, the control apparatus increases the output of the power source beyond a theoretical output of the power source obtained from the target variation amount of the discharge amount, and then sets the output of the power source to the theoretical output such that the change amount of the internal pressure of the nozzle is coincident with an amount by which the internal pressure of the nozzle needs to rise, the amount being obtained from the target variation amount of the discharge amount.

3. The fluid application system according to claim 1, wherein the fluid is a compressible fluid.

4. The fluid application system according to claim 2, wherein the fluid is a compressible fluid.

5. The fluid application system according to claim 1, wherein the fluid supply apparatus includes:

a motion element that makes a motion in accordance with the output of the power source; and a space formation member that forms a space for housing the motion element and sending out the fluid along with the motion of the motion element.

6. The fluid application system according to claim 2, wherein the fluid supply apparatus includes:

a motion element that makes a motion in accordance with the output of the power source; and a space formation member that forms a space for housing the motion element and sending out the fluid along with the motion of the motion element.

7. The fluid application system according to claim 5, wherein the fluid supply apparatus is a uniaxial eccentric screw pump, and includes: a male-threaded rotor as the motion element; and a female-threaded stator as the space formation member.

8. The fluid application system according to claim 6, wherein the fluid supply apparatus is a uniaxial eccentric screw pump, and includes: a male-threaded rotor as the motion element; and a female-threaded stator as the space formation member.

9. The fluid application system according to claim 1, wherein the movement apparatus is an articulated robot that moves the application apparatus.

10. The fluid application system according to claim 2, wherein the movement apparatus is an articulated robot that moves the application apparatus.

11. The fluid application system according to claim 1, wherein the fluid is applied to a surface of the workpiece, and the line width of the fluid applied to the workpiece is a width of the fluid in a direction parallel to the surface of the workpiece to which the fluid is applied.

12. The fluid application system according to claim 2, wherein the fluid is applied to a surface of the workpiece, and the line width of the fluid applied to the workpiece is a width of the fluid in a direction parallel to the surface of the workpiece to which the fluid is applied.

* * * * *